US010153533B2

(12) United States Patent
Kirino

(10) Patent No.: US 10,153,533 B2
(45) Date of Patent: Dec. 11, 2018

(54) WAVEGUIDE

(71) Applicants: Hideki Kirino, Kyoto-shi Kyoto (JP); Nidec Corporation, Kyoto (JP)

(72) Inventor: Hideki Kirino, Kyoto (JP)

(73) Assignees: Hideki Kirino, Kyoto (JP); NIDEC CORPORATION, Kyoto (JP)

( * ) Notice: Subject to any disclaimer, the term of this patent is extended or adjusted under 35 U.S.C. 154(b) by 0 days.

(21) Appl. No.: 15/343,828

(22) Filed: Nov. 4, 2016

(65) Prior Publication Data

US 2017/0077576 A1 Mar. 16, 2017

Related U.S. Application Data

(63) Continuation of application No. PCT/JP2015/063227, filed on May 7, 2015.

(30) Foreign Application Priority Data

May 7, 2014 (JP) ..... 2014-095923

(51) Int. Cl.
*H01P 3/02* (2006.01)
*H01P 1/18* (2006.01)
(Continued)

(52) U.S. Cl.
CPC ..... *H01P 3/02* (2013.01); *H01P 1/182* (2013.01); *H01P 3/123* (2013.01); *H01Q 3/32* (2013.01)

(58) Field of Classification Search
CPC .... H01P 1/18; H01P 1/182; H01P 3/02; H01P 3/123; H01Q 3/32
(Continued)

(56) References Cited

U.S. PATENT DOCUMENTS 4,028,650 A * 6/1977 Konishi ..... H01P 1/00 333/210
8,779,995 B2 7/2014 Kirino et al.
(Continued)

FOREIGN PATENT DOCUMENTS

EP 1 331 688 A1 7/2003
EP 1 470 610 B1 10/2004
WO 2010/050122 A1 5/2010

OTHER PUBLICATIONS

Kirino et al., "A 76 GHz Multi-Layered Phased Array Antenna Using a Non-Metal Contact Metamaterial Waveguide", IEEE Transactions on Antennas and Propagation, vol. 60, No. 2, Feb. 2012, pp. 840-853.

*Primary Examiner* — Stephen E. Jones
*Assistant Examiner* — Samuel S Outten
(74) *Attorney, Agent, or Firm* — Keating & Bennett, LLP

(57) ABSTRACT

A function varying a wavelength in a waveguide including a ridge-shaped conductor and columnar conductors in a parallel flat structure is added to reduce a size of a phase shifter in which input and output ports are fixed. Thus, a phased array antenna including a plurality of phase shifters is reduced in size. A plurality of convex shapes or concave shapes are provided on a conductor plate on a side not including a ridge-shaped conductor and columnar conductors. A mechanism that moves the conductor plate in a direction crossing a direction in which the ridge-shaped conductor extends is applied. After the convex shapes or the concave shapes are changed by a fixed number between phase shifters adjacent to each other, conductor plates are respectively configured by single members. A mechanism that relatively moves the conductor plates in the direction crossing the direction in which the ridge-shaped conductor extends of the phase shifter is applied.

6 Claims, 13 Drawing Sheets

(51) Int. Cl.
*H01P 3/123* (2006.01)
*H01Q 3/32* (2006.01)

(58) Field of Classification Search
USPC ..... 333/248
See application file for complete search history.

(56) References Cited

U.S. PATENT DOCUMENTS

| | | | | |
|---|---|---|---|---|
| 8,803,638 | B2 | 8/2014 | Kildal | |
| 2011/0181373 | A1 | 7/2011 | Kildal | |
| 2011/0187614 | A1* | 8/2011 | Kirino | G01S 7/032 343/713 |

* cited by examiner

WAVEGUIDE

CROSS REFERENCE TO RELATED APPLICATIONS

This application claims the benefit of priority to Japanese Patent Application No. 2014-095923 filed on May 7, 2014 and is a Continuation Application of PCT Application No. PCT/JP2015/063227 filed on May 7, 2015. The entire contents of each application are hereby incorporated herein by reference.

BACKGROUND OF THE INVENTION

1. Field of the Invention

The present invention relates to a waveguide used in microwave and millimeter wave bands and, more particularly, to a technique for enabling a wavelength on the waveguide to be changed to thereby being able to reduce devices such as a phase shifter and a phased array antenna in size compared with conventional devices.

2. Description of the Related Art

Waveguides similar to the present invention are explained in United States Publication No. 2011/0181373 and WO 2010/050122.

United States Publication No. 2011/0181373 is common to WO 2010/050122 and the present invention in a basic structure for confining high-frequency energy to realize a waveguide. WO 2010/050122 is an invention that realizes a phase shifter commonly known as a trombone type using the waveguide of United States Publication No. 2011/0181373 and further realizes a phased array antenna using a plurality of trombone-type phase shifters.

A conventional waveguide and a conventional phase shifter are explained below with reference to figures.

FIG. 12 shows the structure of the conventional waveguide. Reference numeral 1200 denotes the conventional waveguide, 1201 denotes a first conductor plate, 1202 denotes a second conductor plate, 1203 denotes a ridge-shaped conductor, and 1204 denotes columnar conductors. As shown in FIG. 12, the first conductor plate 1201 and the second conductor plate 1202 are disposed with the surfaces thereof opposed to each other. Further, on the first conductor plate 1201, the ridge-shaped conductor 1203 is provided and a plurality of columnar conductors 1204 are cyclically provided in regions on both sides of the ridge-shaped conductor. The height of the columnar conductors 1204 is selected to be ¼ wavelength and the distance between the distal ends of the columnar conductors 1204 and the second conductor plate 1202 is selected as to be ⅛ wavelength to make it possible to efficiently confine high-frequency energy. The sectional shape of the columnar conductors 1204 is set to a square of ⅛ wavelength on each side. The disposition cycle of the columnar conductors 1204 is set to ¼ wavelength.

A principle of transmission of the high-frequency energy by the conventional waveguide 1200 configured as explained above is explained. A parallel flat waveguide is formed by the first conductor plate 1201 and the second conductor plate 1202 disposed with the surfaces thereof opposed to each other. However, since the columnar conductors 1204 having the height of ¼ wavelength are disposed on the surface of the first conductor plate 1201 in a two-dimensional direction at a cycle of ¼ wavelength sufficiently short compared with a wavelength, a surface formed by connecting the distal ends of the columnar conductors 1204 acts as a magnetic wall and an electric current cannot flow. Therefore, the transmission of the high-frequency energy by a parallel flat mode, which is a propagation mode of the parallel flat waveguide, is suppressed. On the other hand, since only the surface of the ridge-shaped conductor 1203 is in a state in which conductors, which are electric walls, are connected, an electric current flows, whereby a waveguide in which the high-frequency energy is transmitted is realized along the ridge-shaped conductor 1203.

The conventional phase shifter is explained with reference to FIG. 13. FIG. 13 shows the sectional shape of a phase shifter in which a pair of the conventional waveguides shown in FIG. 12 is used. In FIG. 13, reference numeral 1300 denotes the conventional phase shifter, 1301 and 1302 denote the conventional waveguides, 1303 and 1304 denote first conductor plates, 1305 and 1306 denote second conductor plates, 1307 denotes an input port, 1308 denotes an output port, 1309 denotes a through-hole, 1310 denotes a transmission line of high-frequency energy, 1311 denotes an intermediate layer, and 1312 denotes a slide direction of the intermediate layer. As shown in FIG. 13, the two conventional waveguides 1301 and 1302 are stuck together such that the positions of ridge-shaped conductors thereof overlap each other and with the backs of the first conductor plates thereof opposed to each other. That is, FIG. 13 shows the sectional shape in the center of the ridge-shaped conductors.

Further, as shown in FIG. 13, in the conventional phase shifter 1300, the input port 1307 is provided in the second conductor plate 1305 of one conventional waveguide 1301, the output port 1308 is provided in the second conductor plate 1306 of the other conventional waveguide 1302, and the through-hole 1309 is provided in the same position of the first conductor plates 1303 and 1304 of the two conventional waveguides 1301 and 1302. Choke structures by distal end short-circuit holes 1313 and 1314 having depth of ¼ of a waveguide wavelength are cut in positions apart from each other by ¼ of the waveguide wavelength in the input port 1307 and the output port 1308, ridge-shaped conductors 1315 and 1316 are cut in positions apart from each other by ¼ of the waveguide wavelength in the through-hole 1309, and choke structures by columnar conductors 1317 and 1318 having height of ¼ wavelength are provided on the outer sides of the ridge-shaped conductors 1315 and 1316, whereby the transmission line 1310 of high-frequency energy is formed. In the conventional phase shifter 1300 configured as explained above, the length of the transmission line 1310 of high-frequency energy formed in a trombone shape is changed by moving the intermediate layer 1311 in the slide direction 1312. Consequently, the phase shifter 1300 changes a phase of the high-frequency energy that enters from the input port 1307 and exits to the output port 1308.

SUMMARY OF THE INVENTION

The conventional waveguide and the phase shifter using the conventional waveguide have a problem described below.

That is, since the conventional phase shifter employs the principle that the physical length of the waveguide is changed, in order to realize the phase shifter with the positions of the input port and the output port fixed, the waveguide needs to be disposed in the trombone shape shown in FIG. 13. Consequently, there is a problem in that a reduction in the size of the phase shifter is limited and, in particular, when a phased array antenna including a plurality of phase shifters is realized, the structure of the phase shifter is complicated and the entire phase shifter increases in size.

In order to solve the problem of the conventional waveguide and the conventional phase shifter, waveguides according to preferred embodiments of the present invention and devices including such waveguides include first and second conductor plates disposed with surfaces thereof opposed to each other. On the first conductor plate, a ridge-shaped conductor is provided and a plurality of columnar conductors are cyclically provided in regions on both sides of the ridge-shaped conductor. Further, a part of the surface of the second conductor plate has a plurality of convex shapes or a plurality of concave shapes.

Further, in the waveguide of the present invention and the device using the waveguide, the second conductor plate is slid with respect to the first conductor plate in a direction orthogonal to the ridge-shaped conductor provided on the first conductor plate.

In the waveguide of the present invention and the device using the waveguide, a plurality of the waveguides configured such that the plurality of convex shapes or the plurality of concave shapes change by a fixed number between the waveguides adjacent to each other are disposed in parallel. All of the first conductor plates and all of the second conductor plates in the plurality of waveguides disposed in parallel are respectively integrally configured. The integrally configured second conductor plates are slid with respect to the integrally configured first conductor plates in a direction orthogonal to the ridge-shaped conductors of the plurality of waveguides disposed in parallel.

Since the waveguides of preferred embodiments of the present invention and the devices including the waveguides have the characteristics explained above, the waveguide and the device using the waveguide solve the problem of the conventional waveguide and the phase shifter using the conventional waveguide. That is, after the plurality of convex shapes or concave shapes are provided on the second conductor plate, the second conductor plate is slid in the direction orthogonal to the ridge-shaped conductor, whereby the length of a current route of high-frequency energy flowing on the second conductor plate is changed. Consequently, a phase shift function is realized by only a single waveguide, the positions of input and output ports of which are fixed. Further, after the waveguides are configured such that the convex shapes or the concave shapes change by the fixed number between the plurality of phase shifters adjacent to each other, the second conductor plates of the plurality of phase shifters are simultaneously slid, whereby a phase shift amount is changed in a state in which a phase difference between the phase shifters adjacent to each other is kept the same. Consequently, a phase shifter for a phased array antenna is realized.

That is, with the above configuration according to preferred embodiments of the present invention, a phase shifter, input and output ports of which are fixed, is able to be reduced in size. Therefore, in particular, a high-frequency device such as a phased array antenna including a plurality of phase shifters is able to be reduced in size.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are explained below.

Preferred Embodiments

First Preferred Embodiment

Figure 1:
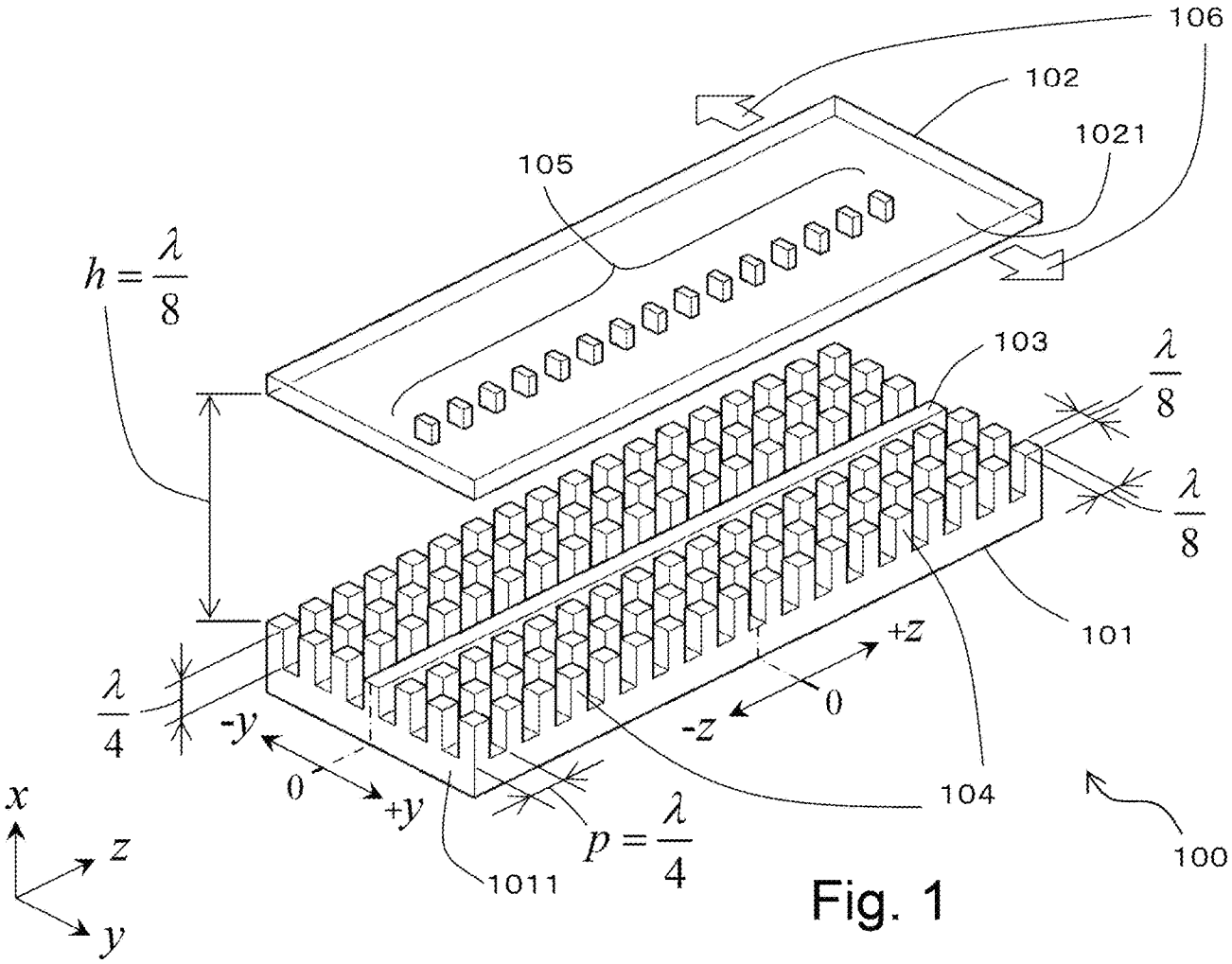
FIG. 1 is a perspective view of a waveguide in a first preferred embodiment of the present invention.

FIG. 1 shows a preferred embodiment of a waveguide in the present invention. In FIG. 1, reference numeral 100 denotes a waveguide, 101 denotes a first conductor plate, 102 denotes a second conductor plate, 103 denotes a ridge-shaped conductor, 104 denotes columnar conductors, 105 denotes a plurality of convex shapes provided in a part of the surface of the second conductor plate 102, and 106 denotes a direction in which the second conductor plate 102 is slid with respect to the first conductor plate 101. Note that, in FIG. 1, the second conductor plate 102 is shown in a transparent view such that the shape of a lower part of the second conductor plate 102 is seen. As shown in FIG. 1, the first conductor plate 101 and the second conductor plate 102 are disposed with the surfaces thereof opposed to each other. Further, on the first conductor plate 101, the ridge-shaped conductor 103 is provided and a plurality of columnar conductors 104 are cyclically provided in regions on both sides of the ridge-shaped conductor. The ridge-shaped conductor 103 and the columnar conductors 104 are formed of a conductor material same as the conductor material of the first conductor plate 101 and integrally with the first conductor plate. Further, the plurality of convex shapes 105 are formed of a conductor material same as the conductor material of the second conductor plate 102 and integrally with the second conductor plate 102.

In the waveguide 100 shown in FIG. 1, the height of the columnar conductors 104 is selected to be ¼ wavelength and the distance between the distal ends of the columnar conductors 104 and the second conductor plate 102 is selected to be ⅛ wavelength such that high-frequency energy can be efficiently confined. Note that, in order to efficiently confine the high-frequency energy, the distance between the distal ends of the columnar conductors 104 and the second conductor plate 102 only has to be smaller than ¼ wavelength without being limited to ⅛ wavelength shown in FIG. 1. In order to efficiently confine the high-frequency energy, a disposition cycle of the columnar conductors 104 is desirably smaller than ½ wavelength. Therefore, as shown in FIG. 1, the sectional shape of the columnar conductors 104 is set to a square of ⅛ wavelength on each side. The disposition cycle of the columnar conductors 104 is set to ¼ wavelength.

A principle of transmission of the high-frequency energy by the waveguide 100 configured as explained above is explained. A parallel flat waveguide is formed by the first conductor plate 101 and the second conductor plate 102 disposed with the surfaces thereof opposed to each other. However, since the columnar conductors 104 having the height of ¼ wavelength are disposed on the surface of the first conductor plate 101 in a two-dimensional direction at a cycle of ¼ wavelength sufficiently short compared with the ½ wavelength, a surface formed by connecting the distal ends of the columnar conductors 104 acts as a magnetic wall and an electric current cannot flow. Therefore, a parallel flat mode, which is a propagation mode of the parallel flat waveguide, is suppressed. The high-frequency energy cannot be transmitted. On the other hand, since only the surface of the ridge-shaped conductor 103 is in a state in which conductors, which are electric walls, are connected, an electric current flows, whereby the high-frequency energy is transmitted along the ridge-shaped conductor 103.

Figure 2:
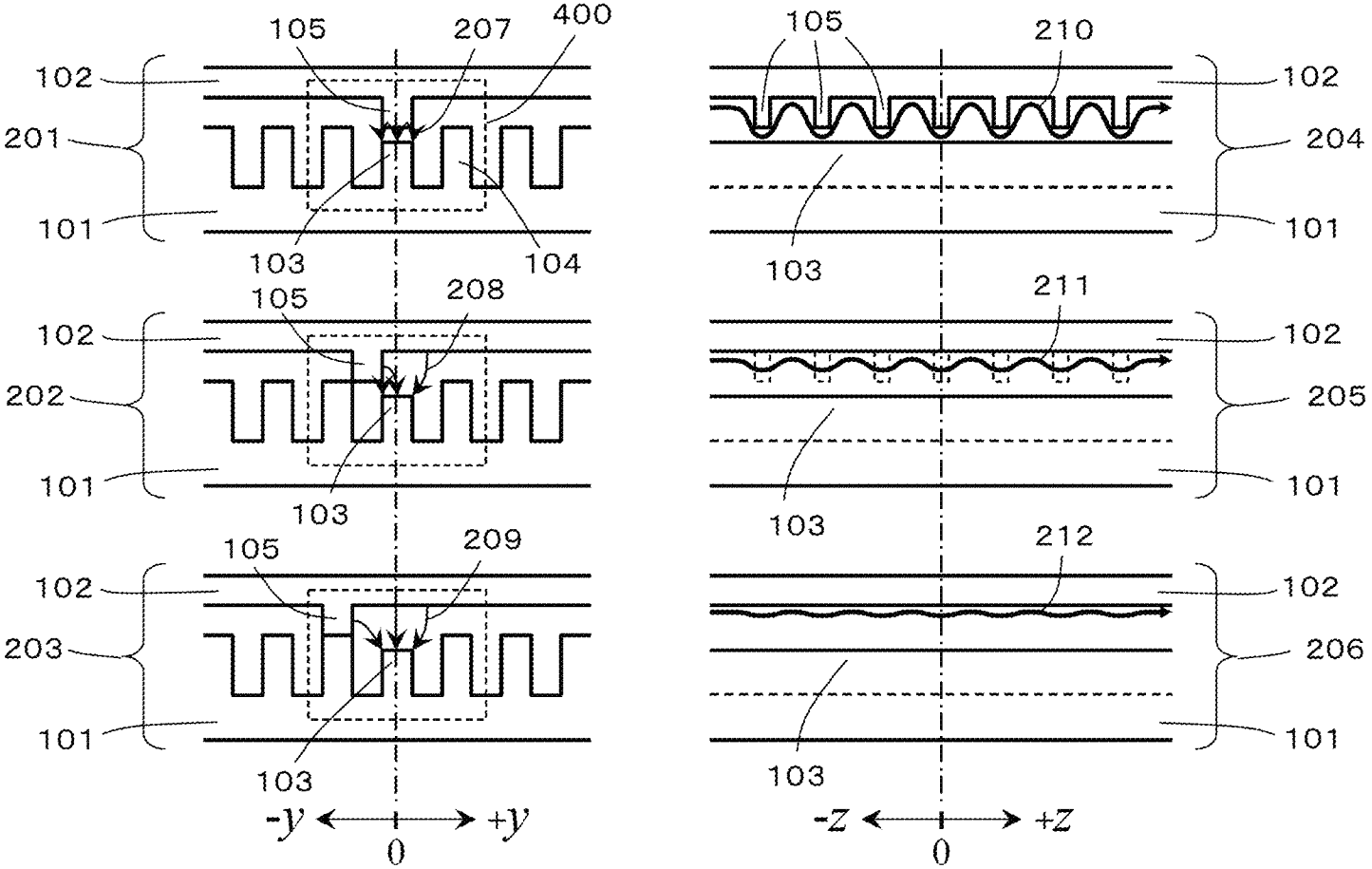
FIG. 2 is a sectional view of the waveguide in the first preferred embodiment of the present invention.

A wavelength varying functions of the waveguide shown in FIG. 1 is explained with reference to FIG. 2. FIG. 2 shows a sectional view of the waveguide at the time when the second conductor plate 102 shown in FIG. 1 is moved in the slide direction 106. In FIG. 2, reference numerals 201, 202, and 203 denote xy sectional views in z=0 represented by a coordinate system shown in FIG. 1 and 204, 205, and 206 denote zx sectional views in y=0. Viewing the sectional views of FIG. 2 in the order of 201, 202, and 203 or in the order of 204, 205, and 206 corresponds to sliding the second conductor plate 102 in a −y direction. Conversely, viewing the sectional views in the order of 203, 202, and 201 or in the order of 206, 205, and 204 corresponds to sliding the second conductor plate 102 in a +y direction. In the sectional views of FIG. 2, reference numerals 207, 208, and 209 denote electric field shapes of high-frequency energy on the waveguide and 210, 211, and 212 denote current routes of the high-frequency energy flowing on the waveguide.

The wavelength varying function of the waveguide of this preferred embodiment is explained with reference to the sectional views of FIG. 2. When the second conductor plate 102 is present in a position shown in the sectional views 201 and 204, since the convex shapes 105 provided on the second conductor plate 102 are present right above the ridge-shaped conductor 103, an electric field shape on the waveguide concentrates between the convex shapes 105 and the ridge-shaped conductor 103 as indicated by 207. Therefore, an electric current flowing on the waveguide flows along the surfaces of the plurality of convex shapes 105 as indicated by a route 210. Subsequently, when the second conductor plate 102 slides and moves to a position shown in the sectional views 202 and 205, since the convex shapes 105 slightly move away from the ridge-shaped conductor 103, the electric field shape on the waveguide changes to a distribution in which the electric field shape enters the ridge-shaped conductor 103 from both of the surfaces of the convex shapes 105 and the second conductor plate 102 as indicated by 208. Therefore, the electric current flowing on the waveguide is slightly linear and short compared with the current route 210 as indicated by the route 211. When the second conductor plate 102 further slides and moves to a position shown in the sectional views 203 and 206, since the convex shapes 105 further move away from the ridge-shaped conductor 103, in the electric field shape on the waveguide, a component entering the ridge-shaped conductor 103 from the second conductor plate 102 as indicated by 209 is predominant. Therefore, the electric current flowing on the waveguide is further linear and shorter compared with the current route 211 as indicated by the route 212.

Consequently, when the second conductor plate 102 is slid in a direction in which the convex shapes 105 move away from the ridge-shaped conductor 103 starting from points where the convex shapes 105 are present right above the ridge-shaped conductor 103, a route of the electric current flowing on the waveguide decreases in length according to an increase in a slide amount. The decrease in the length of the current route is equivalent to a decrease in equivalent waveguide length. Therefore, a phenomenon that a wavelength on the waveguide increases is caused. That is, when the second conductor plate 102 is slid with respect to the first conductor plate 101 in a direction orthogonal to the ridge-shaped conductor 103, the distance between the convex shapes 105 and the ridge-shaped conductor 103 changes. Therefore, the waveguide of this preferred embodiment has the wavelength varying function.

Figure 3:
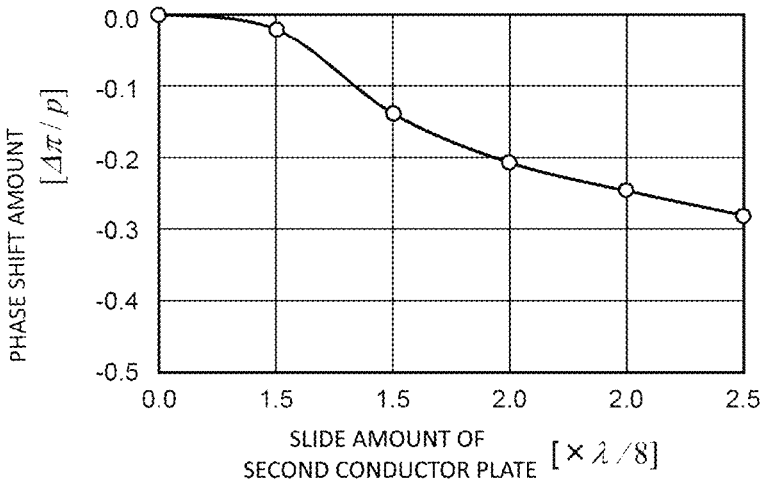
FIG. 3 is a phase shift characteristic diagram of the waveguide in the first preferred embodiment of the present invention.

FIG. 3 shows a phase shift characteristic of the waveguide shown in FIG. 1. The horizontal axis indicates a slide amount of the second conductor plate 102 as a value normalized by ⅛ wavelength and the vertical axis indicates a phase shift amount of high-frequency energy passing through the waveguide as a value normalized by p=¼ wavelength shown in FIG. 1. It is seen that, when the second conductor plate 102 is slid as shown in FIG. 3, it is possible to efficiently phase-shift the high-frequency energy passing through the waveguide. Note that, as shown in FIG. 3, the phase shift amount with respect to the slide amount of the second conductor plate 102 is not linear. This is because, in this preferred embodiment, the sectional shape of the convex shapes 105 provided on the second conductor plate is formed as a simple rectangular parallelepiped. Therefore, when a linear change characteristic is necessary, the sectional shape of the convex shapes 105 provided on the second conductor plate only has to be optimized while calculating a phase shift characteristic by an electromagnetic field simulation such that equivalent length of a route of an electric current flowing on the waveguide at the time when the second conductor plate is slid is proportional to a slide amount.

Figure 4:
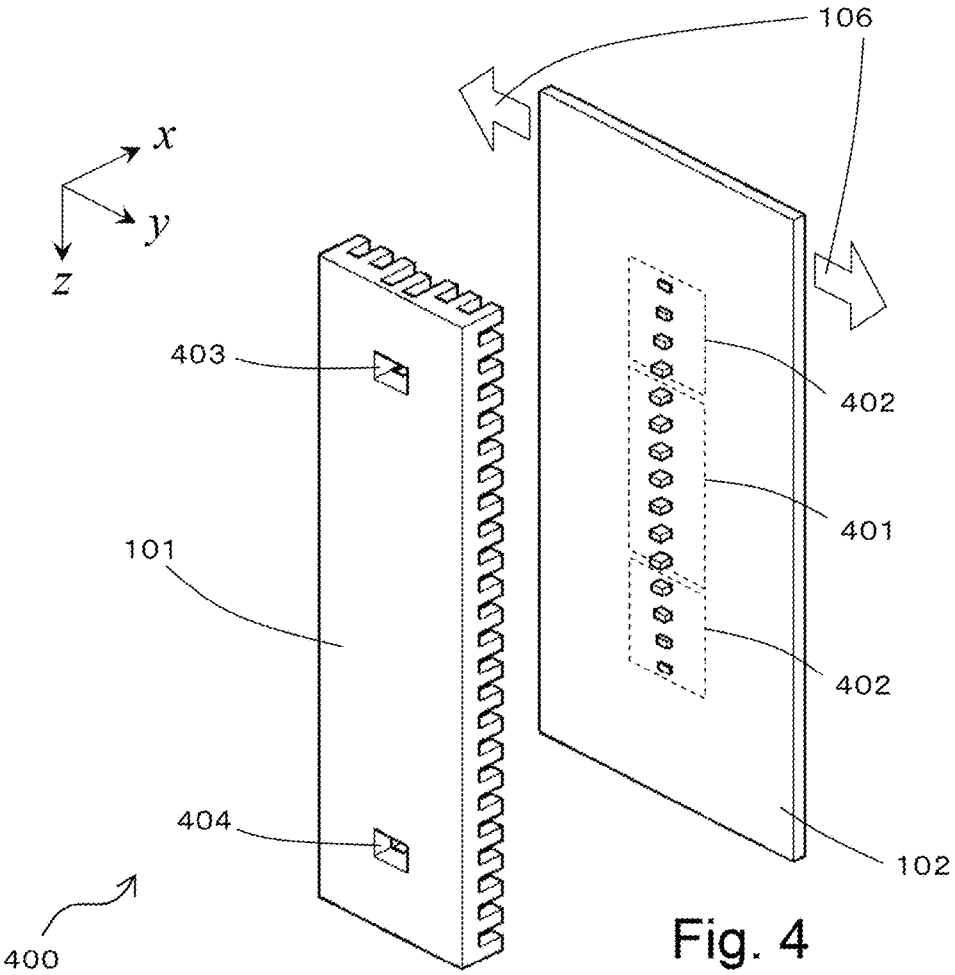
FIG. 4 is a perspective view of a phase shifter using the waveguide of the first preferred embodiment of the present invention.
Figure 5:
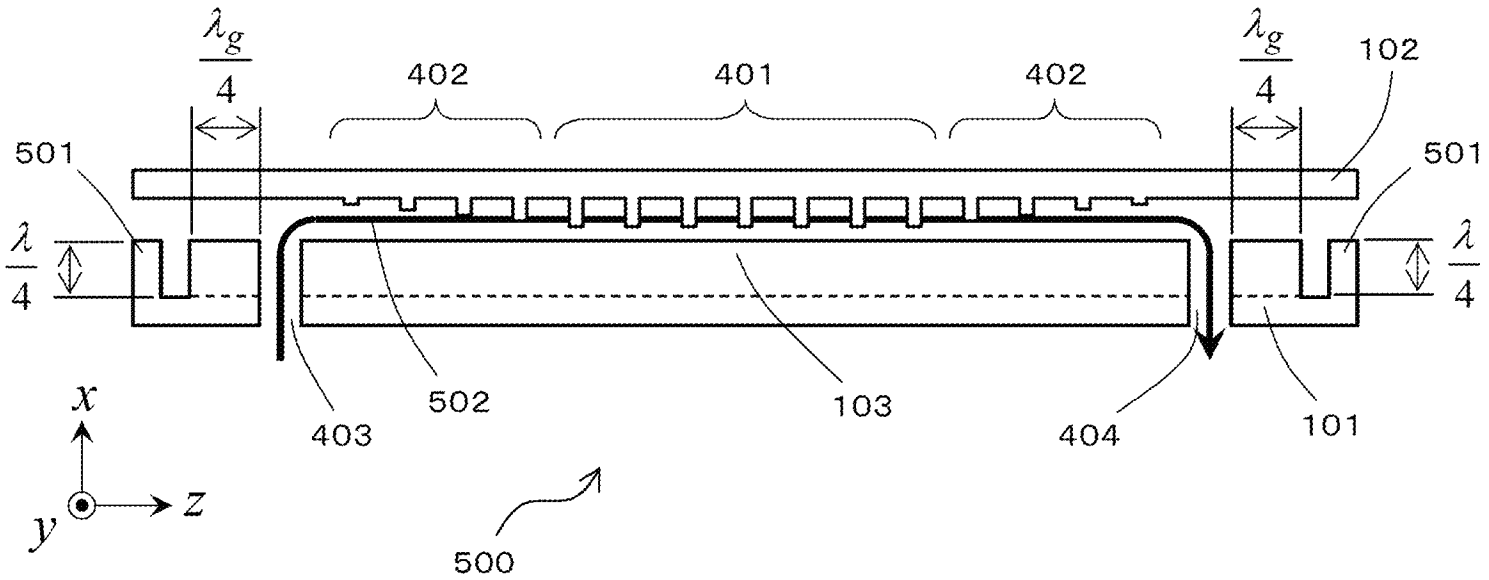
FIG. 5 is a sectional view of the phase shifter using the waveguide of the first preferred embodiment of the present invention.

A phase shifter using the waveguide of this preferred embodiment is explained. FIG. 4 shows the structure of the phase shifter. Reference numeral 400 denotes the phase shifter, 401 denotes a phase shifting section using the waveguide of this preferred embodiment shown in FIG. 1, 402 denotes matching sections, 403 denotes an input port, and 404 denotes an output port. Note that, although hidden by the back of the first conductor plate and not seen in FIG. 4, the phase shifting section 401 and the matching sections 402 also include waveguide sections composed of a ridge-shaped conductor and columnar conductors in regions corresponding to the phase shifting section 401 and the matching sections 402. FIG. 5 shows a sectional view in the center of the ridge-shaped conductor 103 of the phase shifter shown in FIG. 4.

In FIG. 4 and FIG. 5, in the phase shifting section 401, when the second conductor plate 102 is slid in the direction orthogonal to the ridge-shaped conductor 103 as explained above, it is possible to change a waveguide wavelength with respect to the high-frequency energy passing through the phase shifting section 401. On the other hand, the matching sections 402 are a plurality of convex shapes provided on the second conductor plate 102, the heights of which are changed little by little such that the convex shapes are high on the phase shifting section 401 side and low on the input and output port sides. Consequently, an electric field shape of the input and output ports and an electric field shape of the phase shifting section 401 can be gently converted. Therefore, it is possible to always keep matching of the input and output ports 403 and 404 and the phase shifter 400 satisfactory irrespective of the slide amount of the second conductor plate 102.

Figure 13:
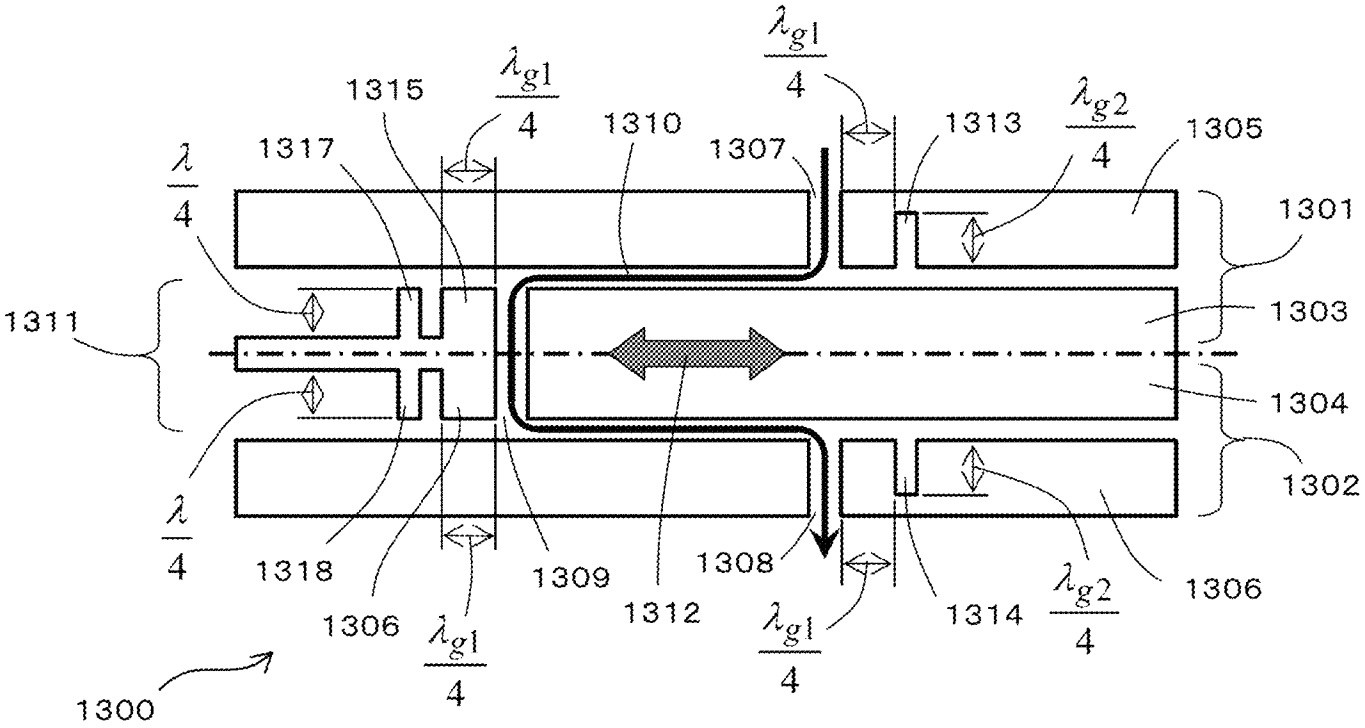
Fig. 13 Prior Art
FIG. 13 is a sectional view of a phase shifter using two conventional waveguides.

Further, as shown in FIG. 5, in the input port 403 and the output port 404, the ridge-shaped conductors 103 is cut in positions apart from each other by ¼ of the waveguide wavelength. Choke structures provided with columnar conductors 501 having height of ¼ wavelength are located on the outer sides of the ridge-shaped conductor 103. Therefore, a transmission line 502 is formed without the high-frequency energy leaking to the outer sides of the input port 403 and the output port 404. With the phase shifter 400 using the waveguide of this preferred embodiment as explained above, when the second conductor plate 102 is slid in the direction orthogonal to the ridge-shaped conductor 103, the transmission line 502 of the high-frequency energy is formed in a state in which the input port 403 and the output port 404 and the phase shifter 400 are always matched. When the second conductor plate 102 is further slid, the waveguide wavelength in the phase shifting section 401 changes. Therefore, it is possible to realize the phase shifter with only a single waveguide. Consequently, it is possible to reduce the phase shifter in size compared with the conventional phase shifter shown in FIG. 13.

Figure 6:
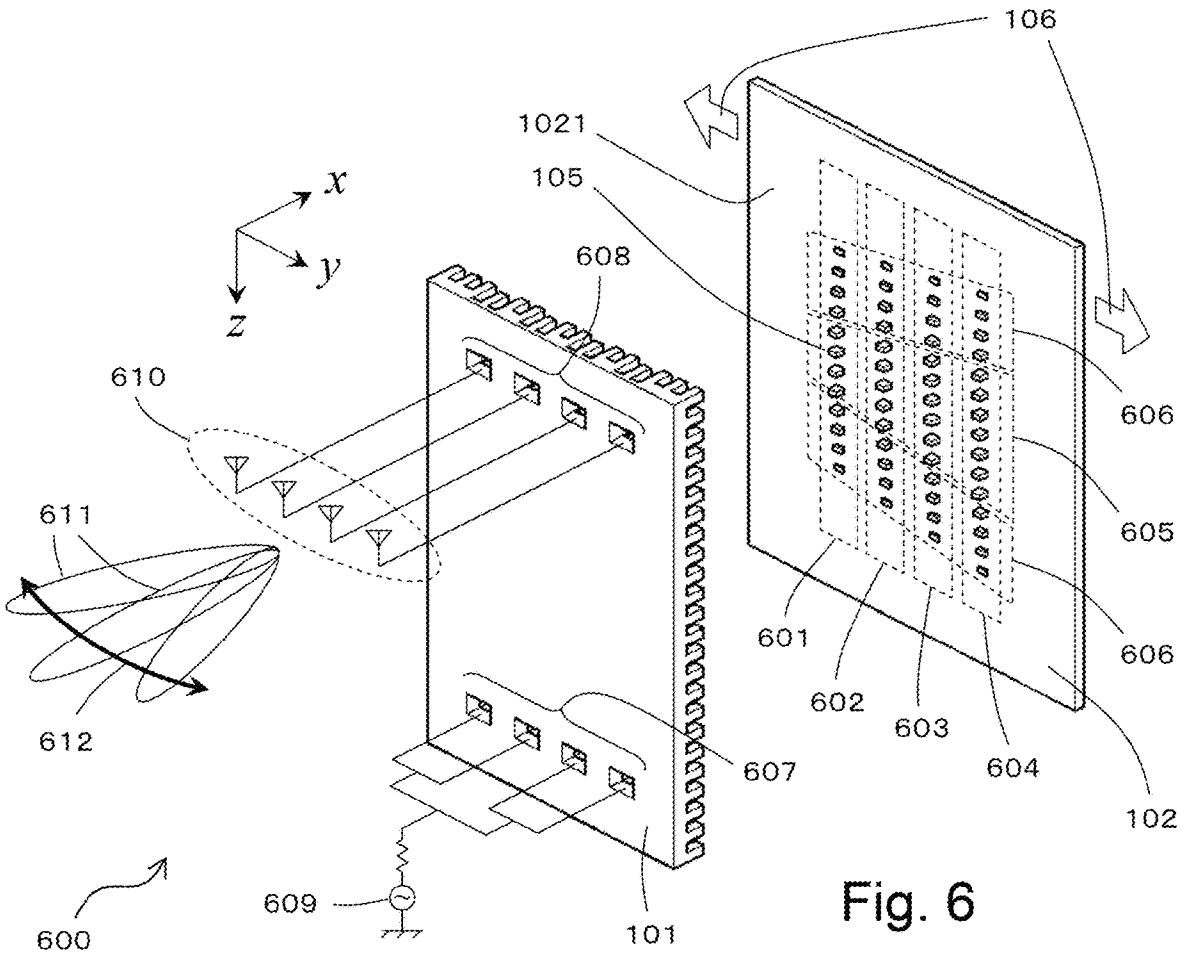
FIG. 6 is a perspective view of a phase shifter for a phased array antenna using a plurality of waveguides of the first preferred embodiment of the present invention.

A phase shifter for a phased array antenna using the waveguide of this preferred embodiment is explained. FIG. 6 shows a phase shifter for a phased array antenna using a plurality of waveguides of this preferred embodiment. In FIG. 6, reference numeral 600 denotes the phase shifter for the phased array antenna, 601 denotes a first phase shifter, 602 denotes a second phase shifter, 603 denotes a third phase shifter, 604 denotes a fourth phase shifter, 605 denotes a phase shifting section, 606 denotes matching sections, 607 denotes input ports, 608 denotes output ports, 609 denotes a signal source, 610 denotes a radiator, 611 denotes radiated beams, and 612 denotes a beam direction. Note that, although hidden by the back of the first conductor plate and not seen in FIG. 6, the first to fourth phase shifters 601 to 604 and the phase shifting section 605 and the matching sections 606 also include waveguide sections by a ridge-shaped conductor and columnar conductors in regions corresponding to the first to fourth phase shifters 601 to 604 and the phase shifting section 605 and the matching sections 606.

As shown in FIG. 6, in the phase shifter for the phased array antenna using the waveguide of this preferred embodiment, the first to fourth phase shifters 601 to 604 are disposed in parallel, the first conductor plates 101 of all the phase shifters and the second conductor plates of all the phase shifters are respectively integrally configured. The input ports 607 and the output ports 608 of all the phase shifters are also provided in the integrally configured first conductor plates 101. Therefore, it is possible to slide the second conductor plates 102 with respect to the first conductor plates 101 in a direction orthogonal to the ridge-shaped conductors of all the phase shifters simultaneously. Further, as shown in FIG. 6, when focusing on the phase shifting section 605 common to the first to fourth phase shifters 601 to 604 disposed in parallel, the phase shifting section 605 is configured such that a plurality of convex shapes change one by one between the adjacent waveguides disposed in parallel. Therefore, a phase shift amount, that is, a phase difference for one convex shape is always added between the phase shifters adjacent to each other.

On the other hand, as shown in FIG. 6, high-frequency energy distributed in equal amplitude and equal phase is input to the input ports 607 from the signal source 609. Therefore, the high-frequency energy always added with the phase difference for one convex shape among all the phase shifters adjacent to one another is output to the output ports 608 and supplied to the radiator 610. When the phase difference for one convex shape is added among all radiation elements adjacent to one another in the radiator 610, the high-frequency energy radiated from the radiation elements is in-phase combined in one direction in which a propagation route difference equivalent to the added phase difference occurs. As a result, the radiated beams 611 are directed to a direction on which the phase difference for one convex shape is reflected. That is, it is possible to realize a phased array antenna that can change the beam direction 612 of the radiated beams 611 by sliding the second conductor plate 102.

Note that, in this preferred embodiment shown in FIG. 6, an example is explained in which the convex shapes change one by one between the waveguides adjacent to each other. However, two or more convex shapes may change. By calculating a phase shift characteristic with the electromagnetic field simulation and optimizing the sectional shape of the convex shapes as explained above, the phase shift amount can be designed to change linearly or along any curve with respect to the slide amount of the second conductor plate 102. Therefore, it is also possible to optionally design a change characteristic of the beam direction of the phased array antenna with respect to the slide amount of the second conductor plate 102.

If the waveguide of this preferred embodiment is used as shown in FIG. 6, in the phase shifter for the phased array antenna including the plurality of phase shifters, the phase shifters can be realized by only one waveguide. Therefore, it is possible to reduce the phase shifter for the phased array antenna in size compared with the conventional phase shifter. As a result, it is possible to reduce the phased array antenna itself in size.

Second Preferred Embodiment

Figure 7:
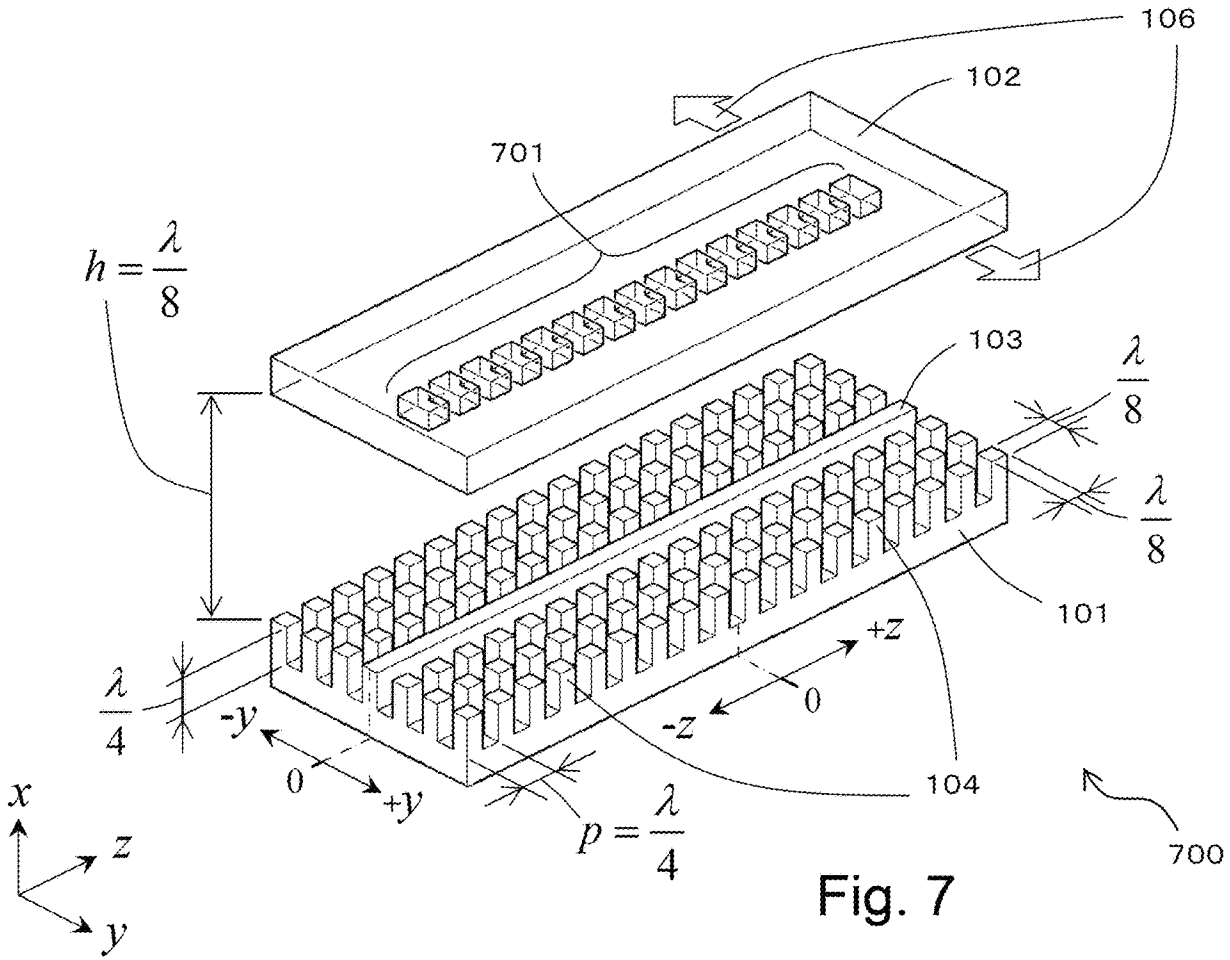
FIG. 7 is a perspective view of a waveguide in a second preferred embodiment of the present invention.

FIG. 7 shows another preferred embodiment of the waveguide in the present invention. In FIG. 7, reference numeral 700 denotes the waveguide, 101 denotes the first conductor plate, 102 denotes the second conductor plate, 103 denotes the ridge-shaped conductor, 104 denotes the columnar conductors, 701 denotes a plurality of concave shapes provided in a part of the surface of the second conductor plate 102, and 106 denotes the direction in which the second conductor plate 102 is slid with respect to the first conductor plate 101.

Note that, in FIG. 7, the second conductor plate 102 is shown in a transparent view such that the shape of the inside of the second conductor plate 102 is seen.

As shown in FIG. 7, the first conductor plate 101 and the second conductor plate 102 are disposed with the surfaces thereof opposed to each other. Further, on the first conductor plate 101, the ridge-shaped conductor 103 is provided and the plurality of columnar conductors 104 are cyclically provided in regions on both sides of the ridge-shaped conductor. The ridge-shaped conductor 103 and the columnar conductors 104 are formed of a conductor material same as the conductor material of the first conductor plate 101 and integrally with the first conductor plate. Further, the plurality of concave shapes 701 are formed by performing machining, for example, cutting of a part of the lower surface of the second conductor plate 102. In the waveguide 700 shown in FIG. 7, all of the height of the columnar conductors 104, the distance between the distal ends of the columnar conductors 104 and the second conductor plate 102, the sectional shape of the columnar conductors 104, and the disposition cycle of the columnar conductors 104 are set the same as those of the waveguide shown in FIG. 1. Therefore, since a principle that high-frequency energy can be transmitted by the waveguide 700 is also the same, explanation of the principle is omitted.

Figure 8:
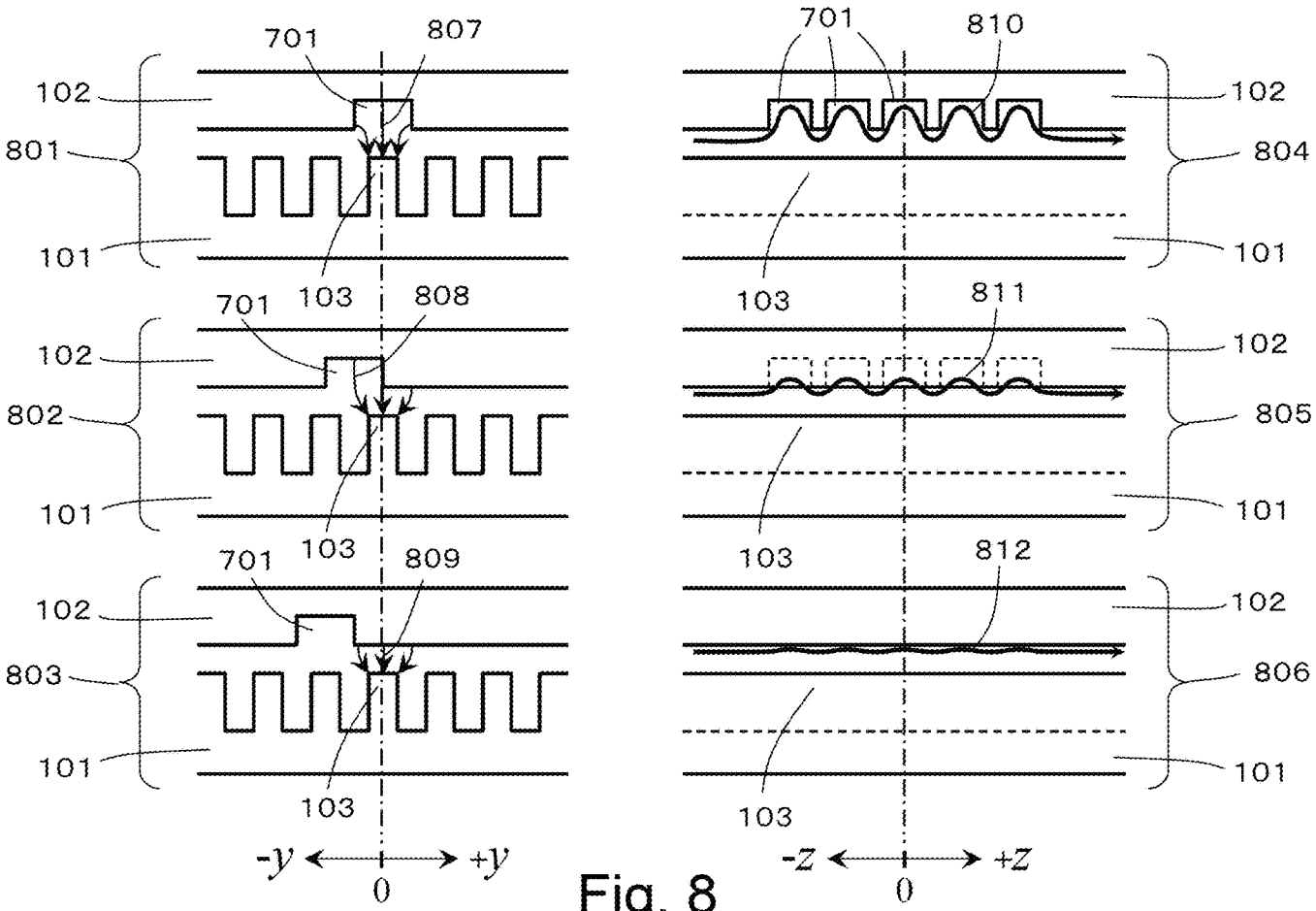
FIG. 8 is a sectional view of the waveguide in the second preferred embodiment of the present invention.

A wavelength varying function on the waveguide of the waveguide shown in FIG. 7 is explained with reference to FIG. 8. FIG. 8 shows a sectional view of the waveguide at the time when the second conductor plate 102 shown in FIG. 7 is moved in the slide direction 106. In FIG. 8, reference numerals 801, 802, and 803 denote xy sectional views in z=0 represented by a coordinate system shown in FIG. 7 and 804, 805, and 806 denote zx sectional views in y=0. Viewing the sectional views of FIG. 8 in the order of 801, 802, and 803 or in the order of 804, 805, and 806 corresponds to sliding the second conductor plate 102 in the −y direction. Conversely, viewing the sectional views in the order of 803, 802, and 801 or in the order of 806, 805, and 804 corresponds to sliding the second conductor plate 102 in the +y direction. In the sectional views of FIG. 8, reference numerals 807, 808, and 809 denote electric field shapes of high-frequency energy on the waveguide and 810, 811, and 812 denote current routes of the high-frequency energy flowing on the waveguide.

The wavelength varying function of the waveguide of this preferred embodiment is explained with reference to the sectional views of FIG. 8. When the second conductor plate 102 is present in a position shown in the sectional views 801 and 804, since the concave shapes 701 provided on the second conductor plate 102 are present right above the ridge-shaped conductor 103, an electric field shape on the waveguide concentrates between the concave shapes 701 and the ridge-shaped conductor 103 as indicated by 807. Therefore, an electric current flowing on the waveguide flows along the surfaces of the plurality of concave shapes 701 as indicated by a route 810. Subsequently, when the second conductor plate 102 slides and moves to a position shown in the sectional views 802 and 805, since the concave shapes 701 slightly move away from the ridge-shaped conductor 103, a distribution of the electric field shape on the waveguide changes to a distribution in which the electric field shape enters the ridge-shaped conductor 103 from both of the surfaces of the concave shapes 701 and the second conductor plate 102 as indicated by 808. Therefore, the electric current flowing on the waveguide is slightly linear and short compared with the current route 810 as indicated by the route 811. When the second conductor plate 102 further slides and moves to a position shown in the sectional views 803 and 806, since the concave shapes 701 further move away from the ridge-shaped conductor 103, in the electric field shape on the waveguide, a component of the electric field entering the ridge-shaped conductor 103 from the second conductor plate 102 as indicated by 809 is predominant. Therefore, the electric current flowing on the waveguide is further linear and shorter compared with the current route 811 as indicated by the route 812.

Consequently, when the second conductor plate 102 is slid in a direction in which the concave shapes 701 move away from the ridge-shaped conductor 103 starting from points where the concave shapes 701 are present right above the ridge-shaped conductor 103, a route of the electric current flowing on the waveguide decreases in length according to an increase in a slide amount. The decrease in the length of the current route is equivalent to a decrease in equivalent waveguide length. Therefore, a phenomenon that wavelength on the waveguide increases is caused. That is, when the second conductor plate 102 is slid with respect to the first conductor plate 101 in a direction orthogonal to the ridge-shaped conductor 103, the distance between the concave shapes 701 and the ridge-shaped conductor 103 changes. Therefore, the waveguide of this preferred embodiment has the wavelength varying function.

Figure 9:
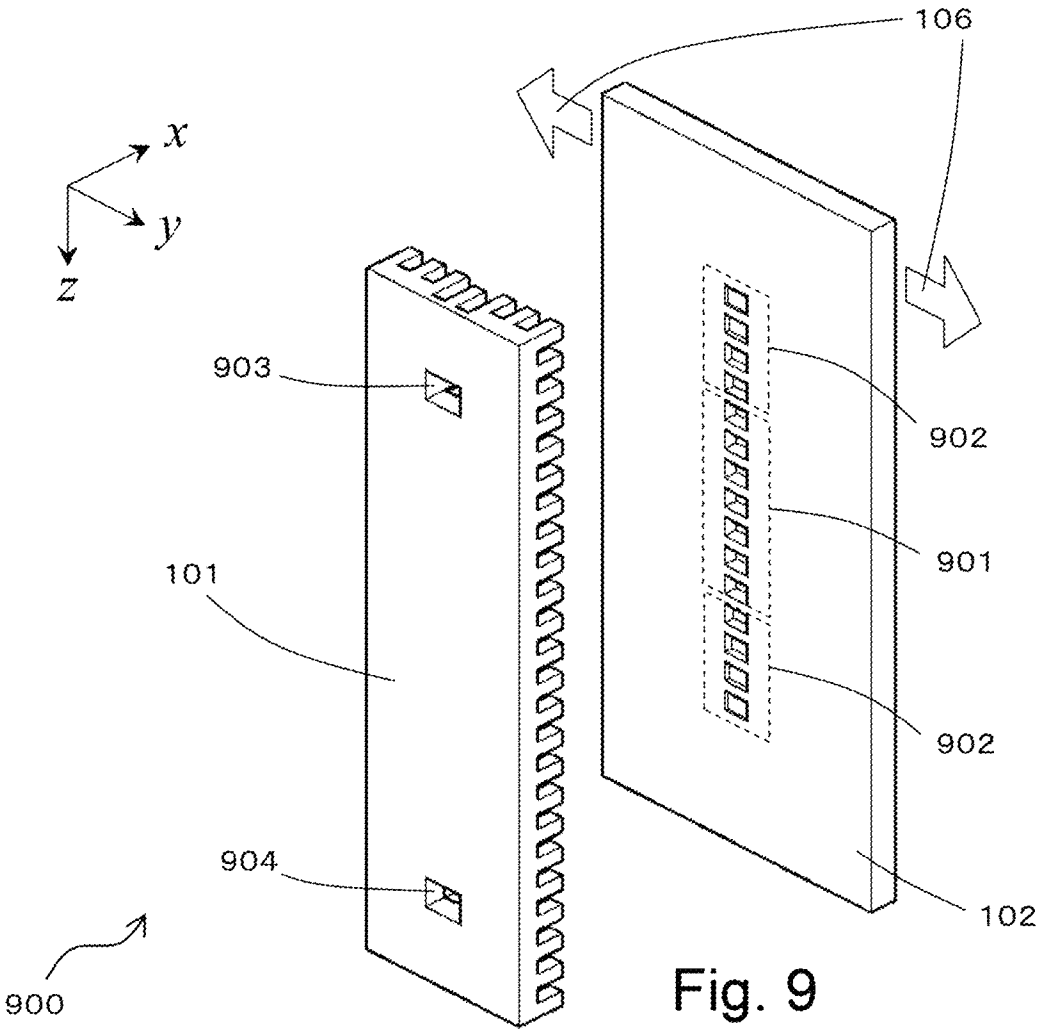
FIG. 9 is a perspective view of a phase shifter using the waveguide of the second preferred embodiment of the present invention.
Figure 10:
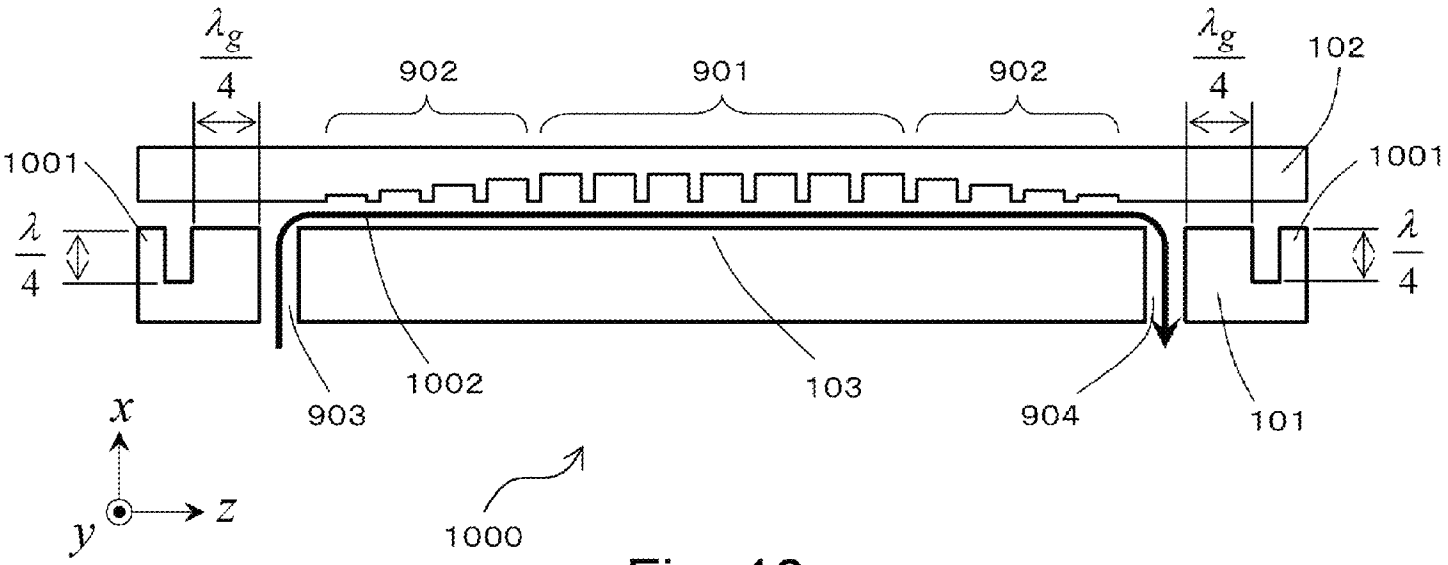
FIG. 10 is a sectional view of the phase shifter using the waveguide of the second preferred embodiment of the present invention.

A phase shifter using the waveguide of this preferred embodiment is explained. FIG. 9 shows the structure of the phase shifter. Reference numeral 900 denotes the phase shifter, 901 denotes a phase shifting section using the waveguide of this preferred embodiment shown in FIG. 7, 902 denotes matching sections, 903 denotes an input port, and 904 denotes an output port. Note that, although hidden by the back of the first conductor plate and not seen in FIG. 9, the phase shifting section 901 and the matching sections 902 also include waveguide sections by a ridge-shaped conductor and columnar conductors in regions corresponding to the phase shifting section 901 and the matching sections 902. FIG. 10 shows a sectional view in the center of the ridge-shaped conductor 103 of the phase shifter shown in FIG. 9. In FIG. 9 and FIG. 10, in the phase shifting section 901, when the second conductor plate 102 is slid in a direction orthogonal to the ridge-shaped conductor 103 as explained above, it is possible to change a waveguide wavelength with respect to the high-frequency energy passing through the phase shifting section 901. On the other hand, the concave shapes in the matching sections 902 are provided on the second conductor plate 102 to change depth little by little such that the concave shapes are deep on the phase shifting section 901 side and shallow on the input and output port sides. Consequently, an electric field shape of the input and output ports and an electric field shape of the phase shifting section 901 can be gently converted. Therefore, it is possible to always keep matching of the input and output ports 903 and 904 and the phase shifter 900 satisfactory irrespective of the slide amount of the second conductor plate 102.

Further, as shown in FIG. 10, in the input port 903 and the output port 904, the ridge-shaped conductor 103 is cut in positions apart from each other by ¼ of the waveguide wavelength. Choke structures provided with columnar conductors 1001 having height of ¼ wavelength are located on the outer sides of the ridge-shaped conductor 103. Therefore, a transmission line 1002 is formed without the high-frequency energy leaking to the outer sides of the input port 903 and the output port 904. With the phase shifter 900 using the waveguide of this preferred embodiment as explained above, when the second conductor plate 102 is slid in the direction orthogonal to the ridge-shaped conductor 103, the transmission line 1002 of the high-frequency energy is formed in a state in which the input port 903 and the output port 904 and the phase shifter 900 are always matched. When the second conductor plate 102 is further slid, the waveguide wavelength in the phase shifting section 901 changes. Therefore, it is possible to realize the phase shifter with only a single waveguide. Consequently, it is possible to reduce the phase shifter in size compared with the conventional phase shifter shown in FIG. 13.

Figure 11:
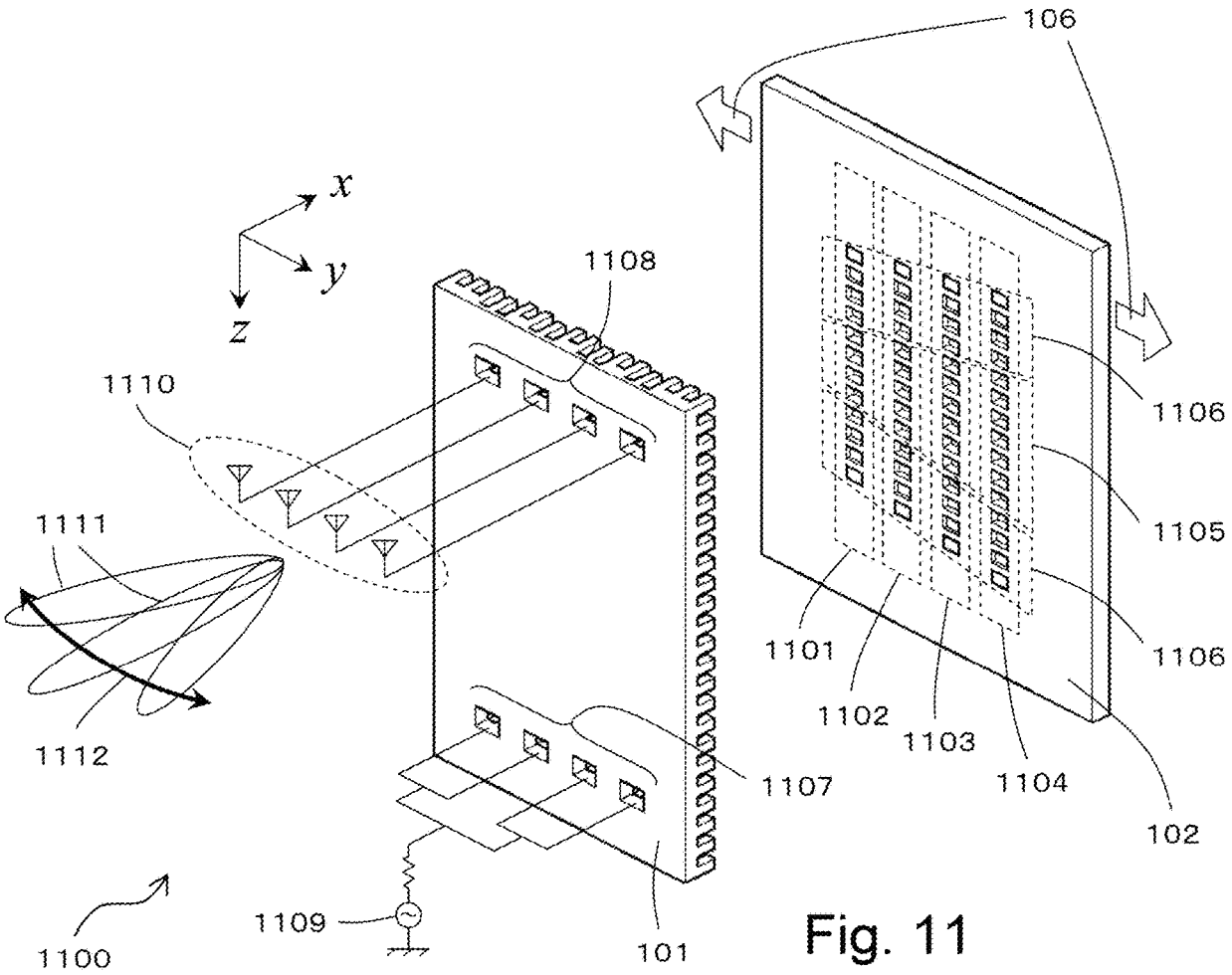
FIG. 11 is a perspective view of a phase shifter for a phased array antenna using a plurality of waveguides of the second preferred embodiment of the present invention.
Figure 12:
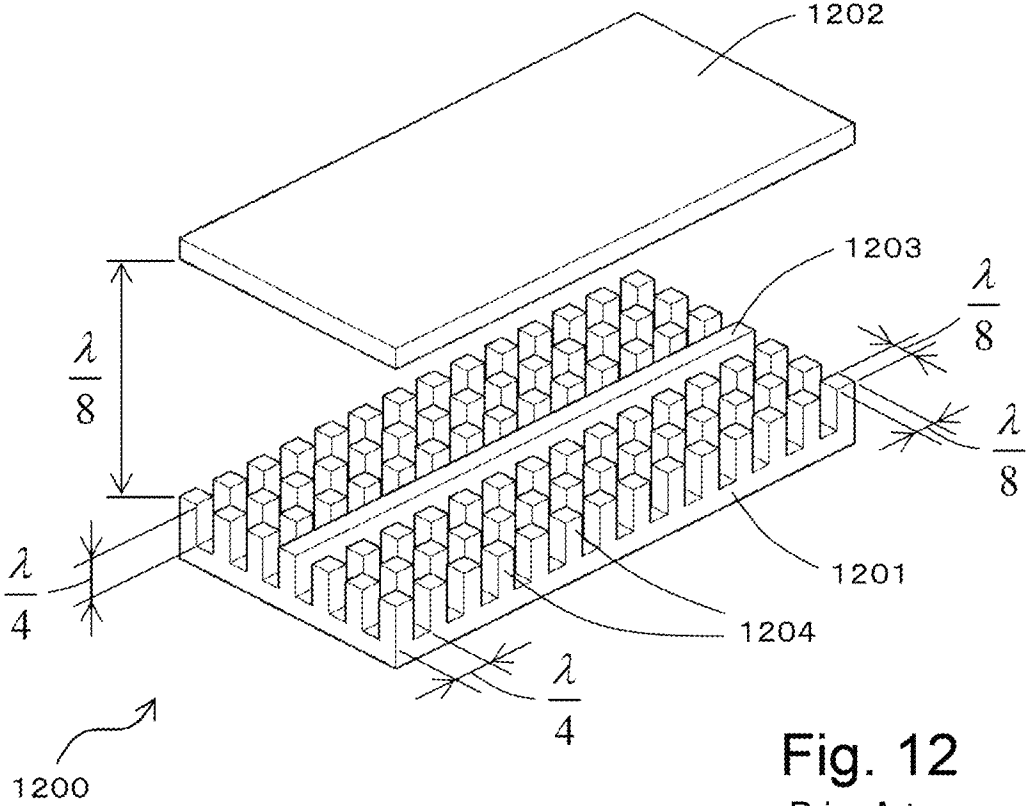
Fig. 12 Prior Art
FIG. 12 is a perspective view of a conventional waveguide.

A phase shifter for a phased array antenna using the waveguide of this preferred embodiment is explained. FIG. 11 shows a phase shifter for a phased array antenna using a plurality of waveguides of this preferred embodiment. In FIG. 11, reference numeral 1100 denotes the phase shifter for the phased array antenna, 1101 denotes a first phase shifter, 1102 denotes a second phase shifter, 1103 denotes a third phase shifter, 1104 denotes a fourth phase shifter, 1105 denotes a phase shifting section, 1106 denotes matching sections, 1107 denotes input ports, 1108 denotes output ports, 1109 denotes a signal source, 1110 denotes a radiator, 1111 denotes radiated beams, and 1112 denotes a beam direction. Note that, although hidden by the back of the first conductor plate and not seen in FIG. 11, the first to fourth phase shifters 1101 to 1104 and the phase shifting section 1105 and the matching sections 1106 also include waveguide sections composed of a ridge-shaped conductor and columnar conductors in regions corresponding to the first to fourth phase shifters 1101 to 1104 and the phase shifting section 1105 and the matching sections 1106. As shown in FIG. 11, in the phase shifter for the phased array antenna using the waveguide of this preferred embodiment, the first to fourth phase shifters 1101 to 1104 are disposed in parallel, the first conductor plates 101 of all the phase shifters and the second conductor plates of all the phase shifters are respectively integrally configured. The input ports 1107 and the output ports 1108 of all the phase shifters are also provided in the integrally configured first conductor plates 101. Therefore, it is possible to slide the second conductor plates 102 with respect to the first conductor plates 101 in a direction orthogonal to the ridge-shaped conductors of all the phase shifters and simultaneously.

Further, as shown in FIG. 11, when focusing on the phase shifting section 1105 common to the first to fourth phase shifters 1101 to 1104 disposed in parallel, the phase shifting section 1105 is configured such that a plurality of concave shapes change one by one between the adjacent waveguides disposed in parallel. Therefore, a phase shift amount, that is, a phase difference for one concave shape is always added between the phase shifters adjacent to each other. On the other hand, as shown in FIG. 11, high-frequency energy distributed in equal amplitude and equal phase is input to the input ports 1107 from the signal source 1109. Therefore, the high-frequency energy always added with the phase difference for one concave shape among all the phase shifters adjacent to one another is output to the output ports 1108 and supplied to the radiator 1110. When the phase difference for one concave shape is added among all radiation elements adjacent to one another in the radiator 1110, the high-frequency energy radiated from the radiation elements is in-phase combined in one direction in which a propagation route difference equivalent to the added phase difference occurs. As a result, the radiated beams 1111 are directed to a direction on which the phase difference for one concave shape is reflected. That is, it is possible to realize a phased array antenna that can change the beam direction 1112 of the radiated beams 1111 by sliding the second conductor plate 102.

Note that, in this preferred embodiment, shown in FIG. 11, an example is explained in which the concave shapes change one by one between the waveguides adjacent to each other. However, two or more concave shapes may change. By calculating a phase shift characteristic with the electromagnetic field simulation and optimizing the sectional shape of the concave shapes as explained in the first preferred embodiment, the phase shift amount can be designed to change linearly or along any curve with respect to the slide amount of the second conductor plate 102. Therefore, it is also possible to optionally design a change characteristic of the beam direction of the phased array antenna with respect to the slide amount of the second conductor plate 102.

If the waveguide of this preferred embodiment is used as shown in FIG. 11, in the phase shifter for the phased array antenna including the plurality of phase shifters, the phase shifters can be realized by only one waveguide. Therefore, it is possible to reduce the phase shifter for the phased array antenna in size compared with the conventional phase shifter. As a result, it is possible to reduce the phased array antenna itself in size.

The preferred embodiments of the present invention can also be explained using names and expressions different from the above. In the following explanation, in order to further facilitate the understanding of the present invention, such names and expressions are introduced together with other modifications of the present invention. Note that it goes without saying that the essence of the present invention is not affected even if the names and the expressions are different.

The first conductor plate 101 may be referred to as first waveguide member 101. The second conductor plate 102 may be referred to as second waveguide member 102. Actually, the first conductor plate 101 and the second conductor plate 102 are not limited to plate-shaped members. For example, it is obvious that the first waveguide member 101 can perform functions same as the functions of the first conductor plate 101 if the first waveguide member 101 includes the plurality of columnar conductors 104 extending toward the second waveguide member 102. However, in this case, the distal ends of the plurality of columnar conductors 104 are not in contact with the second waveguide member. A gap has to be kept between the distal ends and the second waveguide member. Note that the columnar conductors 104 have to be connected to a conductor in the bases on the opposite side of the distal ends. The conductor may be a plate-shaped member but is not limited to this. The member only has to be connected to a base section 1011 that guarantees conduction among the columnar conductors. The columnar conductors 104 may be referred to simply as columnar bodies 104. This is because the columnar bodies do not need to be conductors to the inside and may be, for example, members obtained by plating the surfaces of members made of resin with a conductor. Similarly, the base section does not need to be a conductor to the inside and may be a member obtained by plating the surface of a member made of resin with a good conductor such as copper or nickel.

The second conductor plate 102, that is, the second waveguide member 102 is not limited to the plate shape. However, the second conductor plate 102 or the second waveguide member 102 needs to include a shielding surface 1021 opposed to the plurality of columnar conductors 104 or the columnar bodies 104 via a gap. The second waveguide member 102 needs to include convex sections 105 surrounded by the shielding surface 1021. Concave sections 701 may be disposed instead of the convex sections 105.

Both of convex sections and concave sections may be disposed. The second conductor plate 102 or the second waveguide member 102 does not need to be a conductor to the inside. For example, the second conductor plate 102 or the second waveguide member 102 may be a member obtained by plating the surface of a member made of an insulating material with a good conductor such as copper or nickel. Similarly, the convex sections 105 do not need to be conductors to the inside. The surfaces of the convex shapes made of resin only have to have a structure plated with a good conductor. The convex shapes only have to conduct with the shielding surface 1021 around the convex shapes. At least the surfaces of the inner surfaces of the concave sections 701 only have to be made of conductors. The concave sections 701 only have to conduct with the shielding surface 1021 around the concave sections 701.

The ridge-shaped conductor 103 can be referred to as beam 103. In this case, the beam 103 may be joined to the first waveguide member as drawn in FIG. 1 but may be separated from the first waveguide member. In the latter case, the name of beam is more suitable. The ridge-shaped conductor 103 or the beam 103 does not need to be a conductor to the inside. The ridge-shaped conductor 103 or the beam 103 may be a member obtained by plating a ridge-shaped part made of resin or the surface of the beam with a good conductor.

FIG. 2 shows the cross sections 201, 202, and 203 in three situations in which relative positions of the first waveguide member 101 and the second waveguide member 102 are different in the waveguide 100 shown in FIG. 1. The waveguide 100 includes a not-shown driving mechanism. The driving mechanism can change a state of the waveguide 100 among three states shown in FIG. 2. In this example, the driving mechanism can continuously change a relative position of the second waveguide member relative to the first waveguide member 101. However, the driving mechanism is not limited to this. The sectional view 202 shows a state halfway in transition from a state of a first relative position of the sectional view 201 to a second relative position of the sectional view 203.

The driving mechanism may discontinuously transition the relative position among three relative positions shown in FIG. 2. In this example, the driving mechanism changes the relative position while keeping constant the size of the gap between the shielding surface 1021 of the second waveguide member 102 and the distal ends of the columnar bodies 104. However, the driving mechanism is not limited to this. The driving mechanism may change the size of the gap halfway in the movement. All of these are included in the scope of claims of the present invention.

In the sectional view 201 of FIG. 2, the convex sections 105 are located right above the ridge-shaped conductor 103 or the beam 103. This position is referred to as a first relative position of the first waveguide member 101 relative to the second waveguide member 102. In the first relative position, a range in which the convex sections 105 and the beam 103 overlap when viewed along a direction perpendicular to the shielding surface 1021 has a largest area. This area is referred to as a first area. In the sectional view 203, the convex sections 105 are present in a position most apart from the beam 103. This is called a second relative position of the first waveguide member 101 relative to the second waveguide member 102. In the second relative position, a range in which the convex sections 105 and the beam 103 overlap when viewed along the direction perpendicular to the shielding surface 1021 has a smallest area. The area is zero in the example shown in the sectional view 203.

The columnar bodies 104 are arranged side by side to surround the side surfaces of the beam 103. The shielding surface 1021 spreads to cover the distal end sides of the columnar bodies 104. One phase shifter is configured by the second waveguide member 102 including the columnar bodies 104, the beam 103, and the shielding surface 1021. When the first waveguide member 101 and the second waveguide member 102 change the relative positions, the convex sections 105 surrounded by the shielding surface 1021 have to be located above the beam 103 in at least any one of the relative positions. Such convex sections are also essential constituent elements of the phase shifter. Instead of the convex sections, the concave sections 701, 901, 1105, and 1106 shown in FIGS. 7 to 11 may be disposed.

A plurality of phase shifters may be configured on one first waveguide member 101. In that case, the first waveguide member 101 needs to include a plurality of beams. However, the present invention holds if there is not-shown one driving mechanism interposed between the first waveguide member 101 and the second waveguide member 102. A plurality of driving mechanisms may be interposed. A plurality of convex sections are disposed above the respective beams. However, a configuration may be adopted in which the plurality of beams share one convex section.

FIG. 6 is an example in which a plurality of phase shifters 601, 602, 603, and 604 are configured by a pair of the first waveguide member 101 and the second waveguide member 102. The second waveguide member 102 includes a plurality of convex sections 105 surrounded by the shielding surface 1021. The convex sections 105 form four rows. A part formed by the convex sections having the same size near the centers among the convex sections 105 is referred to as phase shifting section 605. In parts opposed to the four rows of the first waveguide member 101, although hidden and not shown in the figure, four beams 103 are arranged side by side. Each of the four beams 103 is surrounded by the columnar bodies 104.

In the example shown in FIG. 6, the rows of the beams 103 and the columnar bodies 104 vertically extend with respect to the slide direction 106 at the time when the second waveguide member 102 changes the relative position relatively to the first waveguide member 101. The number of the convex sections 105 configuring the phase shifting section 605 and opposed to the beams 103 is different according to the row of the convex sections. Therefore, a phase difference given to high-frequency energy passing through the phase shifters when the relative position change is also different for each of the rows of the convex sections 105, that is, each of the phase shifters. While setting the number of the convex sections opposed to the respective beams 103 the same, it is also possible to slightly incline the rows of the convex sections 105 and differentiate an angle of the inclination for each of the phase shifters. Alternatively, it is also possible to slightly incline the respective plurality of beams 103 and differentiate angles of the inclination from one another.

In the preferred embodiments of the present invention, the phase shifters and the phased array antennas using the waveguide are explained above. However, it goes without saying that the devices using the waveguide of the present invention are within an applied scope of the present invention. Further, it goes without saying that other devices including the phase shifters and the phased array antennas explained in the preferred embodiments of the present invention are within the applied scope of the present invention.

In preferred embodiments of the present invention, the phased array antenna can be reduced in size as explained above. In addition, since an expensive semiconductor is not used in the phase shifter for the phased array antenna, it can be greatly expected that the phase shifter is applied to a vehicle-mounted millimeter wave radar, a ground-to-airplane communication system including a large number of base stations, a distributed meteorological radar system, a wall-stuck-type satellite broadcast receiving antenna in a snowfall region, and the like.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A waveguide, comprising:

a first conductor plate and a second conductor plate which are opposed to each other; wherein the first conductor plate includes a ridge-shaped conductor and a plurality of columnar conductors in regions on both sides of the ridge-shaped conductor;

the second conductor plate includes a plurality of convexities or a plurality of concavities at least on a portion of a surface of the second conductor plate; and the second conductor plate is structured to move with respect to the first conductor plate in a direction crossing a length direction of the ridge-shaped conductor.

2. The waveguide according to claim 1, wherein at least one of the first conductor plate, the second conductor plate, and the ridge-shaped conductor includes an insulator including a surface covered with a conductor film.

3. The waveguide according to claim 1, wherein a longest side of the ridge-shaped conductor extends farthest in the length direction.

4. A waveguide, comprising:

a first conductor plate and a second conductor plate which are parallel or substantially parallel to each other; wherein the first conductor plate includes a first ridge-shaped conductor and a second ridge-shaped conductor, and a plurality of columnar conductors in regions on opposing sides of the first ridge-shaped conductor and the second ridge-shaped conductor;

the first ridge-shaped conductor and the second ridge-shaped conductor are parallel or substantially parallel to each other;

the second conductor plate includes a plurality of convexities or a plurality of concavities at least on a portion of the surface opposed to the first ridge-shaped conductor and the second ridge-shaped conductor; and the first conductor plate is structured to move relative to the second conductor plate in a direction which crosses a length direction of the first ridge-shaped conductor and the second ridge-shaped conductor.

5. The waveguide according to claim 4, wherein at least one of the first conductor plate, the second conductor plate, and the ridge-shaped conductor includes an insulator including a surface covered with a conductor film.

6. The waveguide according to claim 4, wherein a longest side of the first ridge-shaped conductor and a longest side of the second ridge-shaped conductor both extend farthest in the length direction.

* * * * *